US007537490B1

(12) United States Patent
Hovey et al.

(10) Patent No.: US 7,537,490 B1
(45) Date of Patent: May 26, 2009

(54) METHOD AND DEVICE FOR SHARING SIGNALS FROM A PORTABLE MEDIA PLAYER

(75) Inventors: Dean A. Hovey, Los Altos, CA (US); Phil Johnson, Mullumbimby (AU); Chris Tacklind, Palo Alto, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 11/728,639

(22) Filed: Mar. 27, 2007

(51) Int. Cl.
*H01R 24/04* (2006.01)

(52) U.S. Cl. ..... 439/669; 439/668; 439/923; 381/384; 455/575.2

(58) Field of Classification Search ..... 439/668–669, 439/923, 474, 341; 455/575.2; 381/384
See application file for complete search history.

(56) References Cited

U.S. PATENT DOCUMENTS 5,790,947 A * 8/1998 Dieringer ..... 455/345
6,600,826 B1 * 7/2003 Xavier ..... 381/384
6,707,924 B1 * 3/2004 Okiebisu ..... 381/385
6,827,693 B2 * 12/2004 White et al. ..... 600/585
6,910,911 B2 * 6/2005 Mellott et al. ..... 439/358
7,187,948 B2 * 3/2007 Alden ..... 455/557
7,340,221 B2 * 3/2008 Wikel et al. ..... 455/90.3
2004/0082360 A1 * 4/2004 Gunter et al. ..... 455/556.1
2007/0025579 A1 * 2/2007 Kolton ..... 381/384

* cited by examiner

*Primary Examiner*—Michael C Zarroli
(74) *Attorney, Agent, or Firm*—William E. Winters; Michael D. Rodriguez

(57) ABSTRACT

A device for sharing signals from a portable media player is disclosed. The device includes a headset, a media player connector, a cable connected to the headset and the media player connector, and a breakaway connector connected to the device for sharing signals.

23 Claims, 8 Drawing Sheets

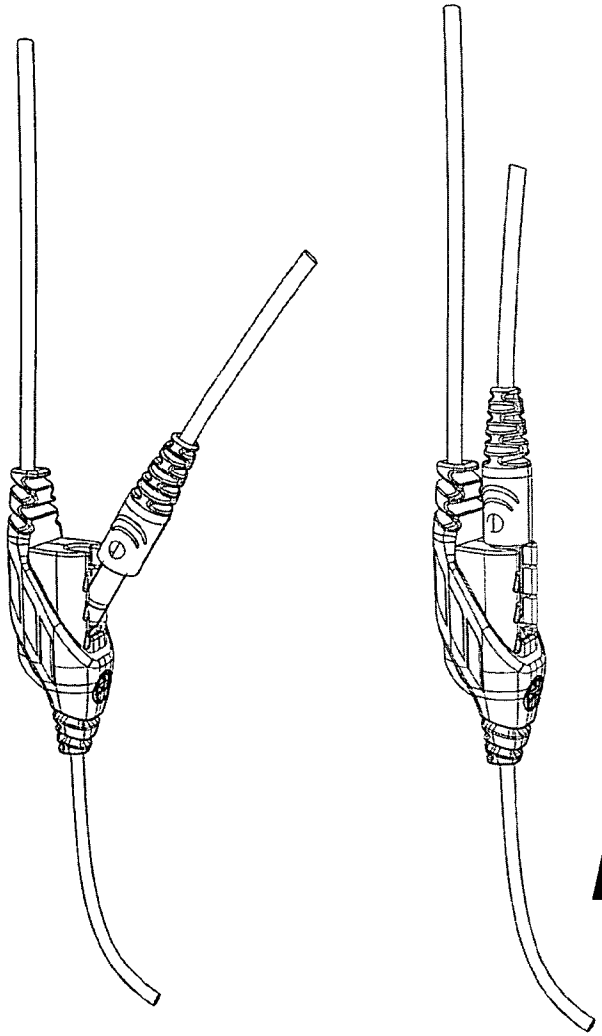
FIG. 13
FIG. 12
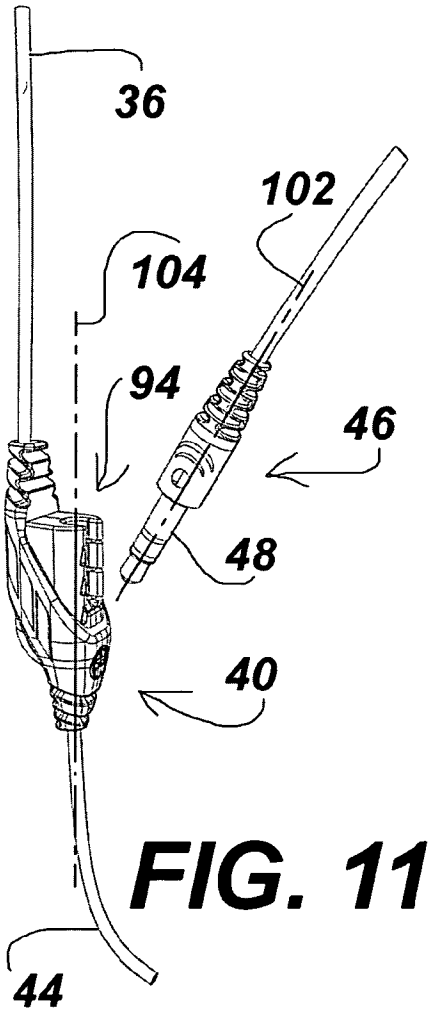
FIG. 11

METHOD AND DEVICE FOR SHARING SIGNALS FROM A PORTABLE MEDIA PLAYER

FIELD OF THE INVENTION

The present invention relates generally to the field of sound transducers, including headsets used with portable media players such as the Apple iPOD and devices to play music in the MP3 or other formats.

BACKGROUND OF THE INVENTION

There are a number of portable systems giving one the ability to play music, such as the Apple iPOD, compact disc players and computer-based systems to play MP3 format music. Different types of headset devices such as headphones and ear bud devices can be used to position and stabilize audio transducers or speakers adjacent to a user's ear or ears.

A user can connect the headset to the media player so that one can hear the music without disturbing others. Also, a user can allow another person to share the music by connecting a second headset to the same media player. One such conventional system is shown in FIG. 1, which includes a plug 10 which can be plugged into a jack in the media player. Two cables 12 and 14 connect the plug 10 to two jacks 20 and 22 so that two headsets, not shown, can be connected, one to each jack 20 and 22. Thereby two listeners can hear music from the same media player. But this requires that the first headset be unplugged in order to install the adapter. In a player with auto load detection this may cause the level out to be re assigned (as on a laptop).

Another conventional system is shown in FIG. 1A and includes a jack 24 which is connected to two cables 25 and 26. One of the cables is connected to a primary headset, not shown, while the other of the cables can be connected to a media player. The plug of a secondary headset, not shown, can be temporarily plugged into the jack 24 to allow a secondary user to listen to the media player.

We have found that sometimes a user can forget that he or she is sharing a media player with another user and can pull away from the other user without first carefully disconnecting his headphones from the jack. This can cause damage to the media device by causing it to fall to the ground either from the pocket of the other user or from the user's hand.

Accordingly it would be desirable to have a means whereby when two users are connected to the same media device and one user abruptly pulls away, the likelihood of damage to the media player can be reduced.

SUMMARY OF THE INVENTION

A device to allow two users to use two headset systems to share music from a portable media player is disclosed. The device includes a headset, a media player connector, a cable connected to the headset and the media player connector, and a breakaway connector.

To use the disclosed device, the users initially engage the plug of the second headset system in the breakaway connector; and then they are able to safely disengage the plug of the second headset system from the breakaway connector without carefully disconnecting them. In other words, if one user rapidly moves away from the other user and applies tension to the cable, the plug is safely released from the connector.

Further features and advantages of the present invention, as well as the structure and operation of the above-summarized and other exemplary embodiments of the invention, are described in detail below with respect to accompanying drawings, in which like reference numbers are used to indicate identical or functionally similar elements.

BRIEF DESCRIPTION OF THE DRAWINGS

FIG. 11 is an illustration of a step in the operation of the present embodiment;

FIG. 12 is an illustration of another step in the operation of the present embodiment;

FIG. 13 is an illustration of another step in the operation of the present embodiment;

DETAILED DESCRIPTION

Figure 1:
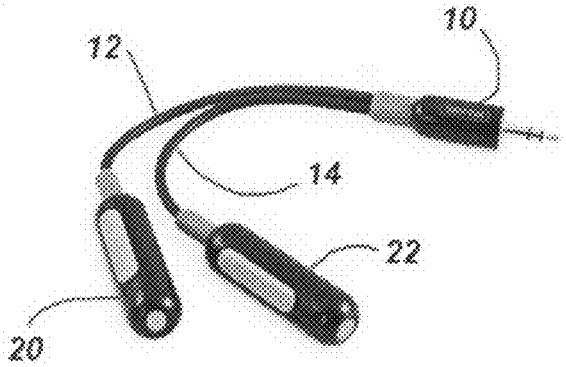
FIG. 1 PRIOR ART
FIG. 1 is an isometric view of a conventional system for two users to share music from the same media player.
Figure 1A:
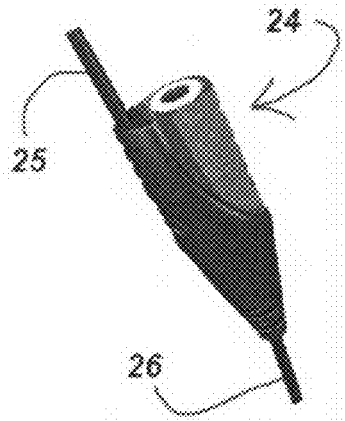
FIG. 1A PRIOR ART
FIG. 1A is an isometric view of another conventional system for two users to share music from the same media player.
Figure 2:
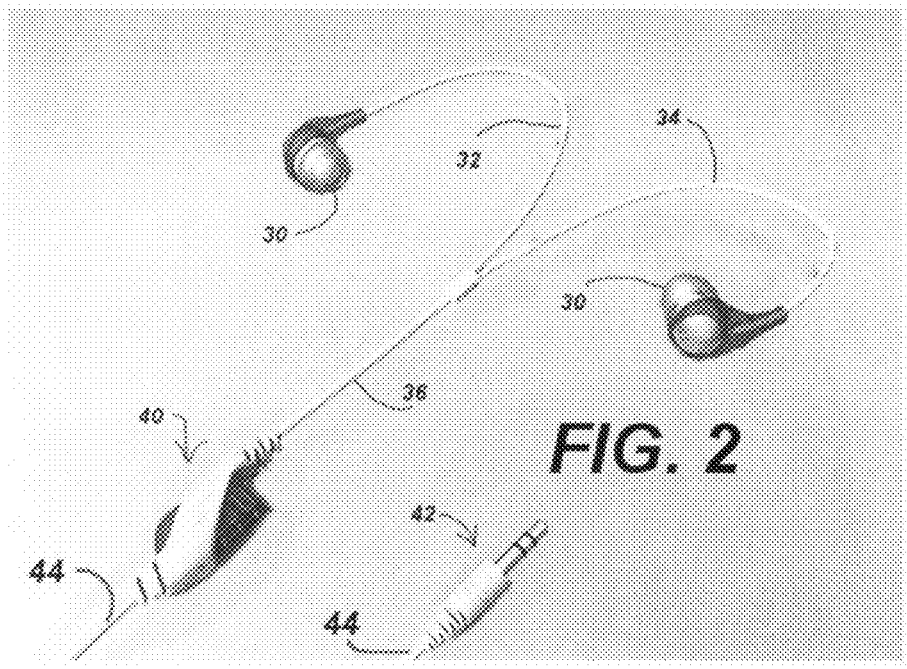
FIG. 2 is an isometric view of an embodiment of the present invention.
Figure 4:
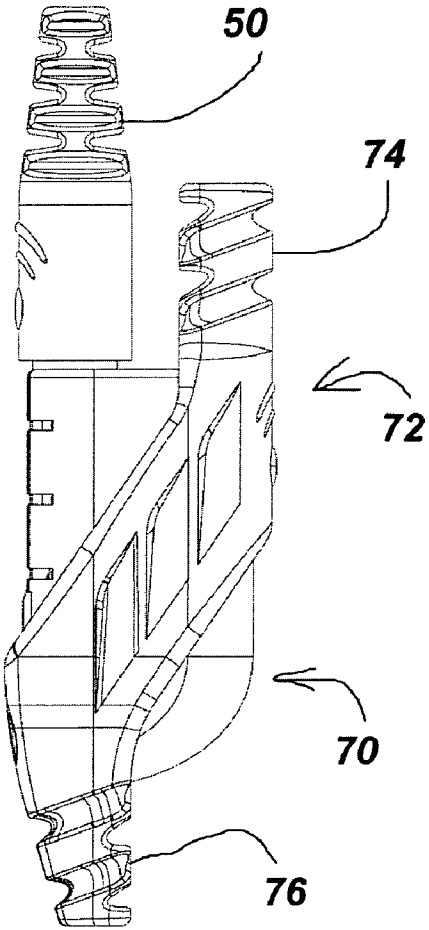
FIG. 4 is an elevation view of the breakaway connector of the present embodiment with a conventional plug.
Figure 3:
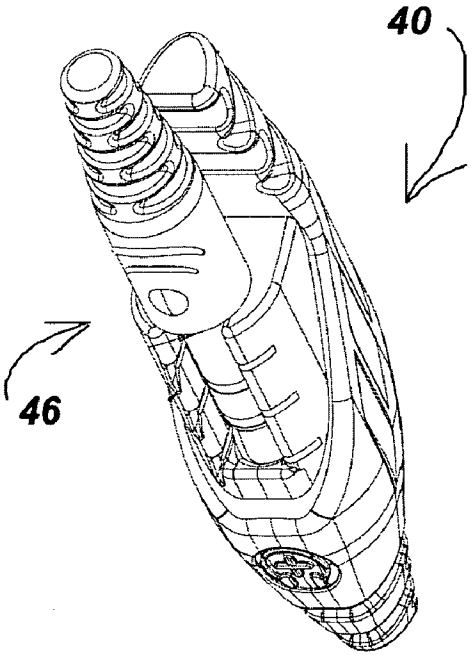
FIG. 3 is an isometric view of a breakaway connector of the present embodiment with a conventional plug.
Figure 6:
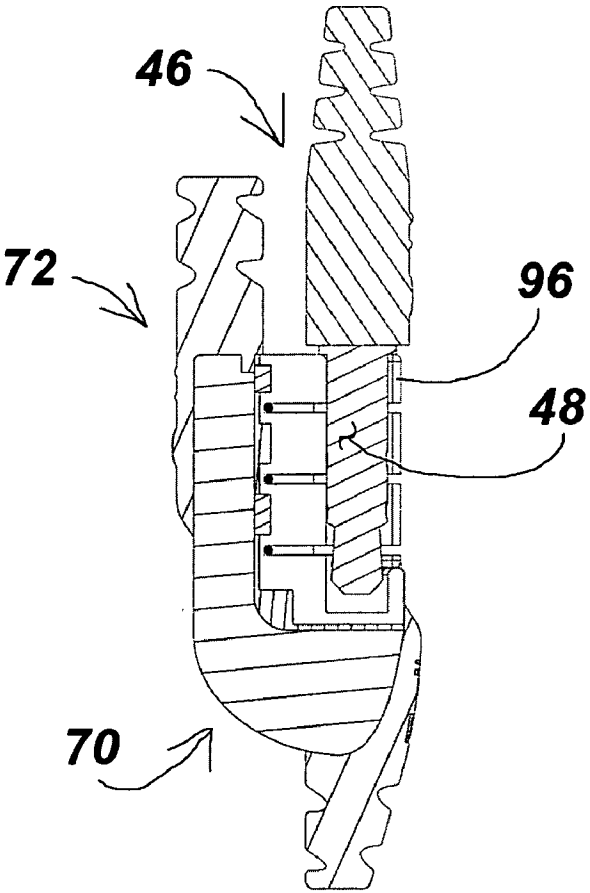
FIG. 6 is a cross section of the components of FIG. 5 taken along line 6-6.
Figure 5:
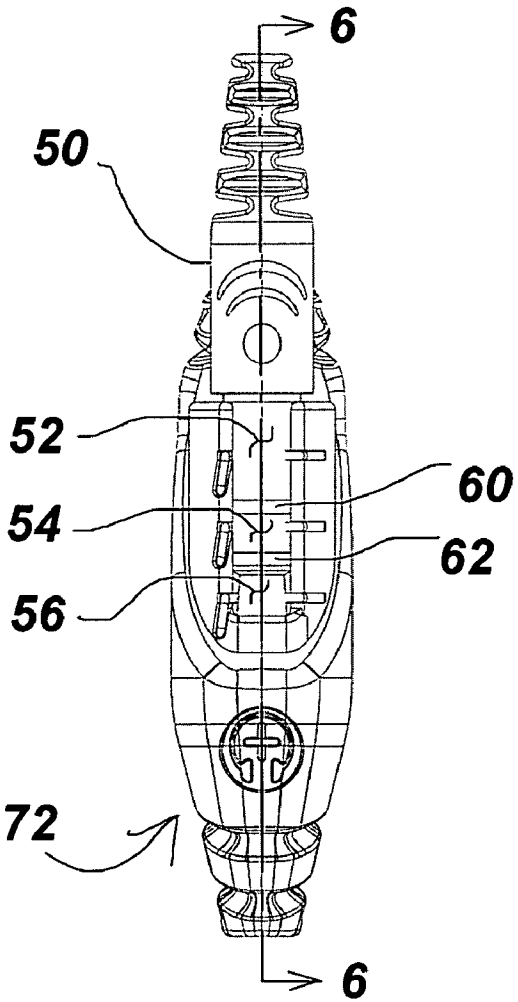
FIG. 5 is a front view of the breakaway connector of the present embodiment with a conventional plug.

With reference now to FIGS. 2-10 there is illustrated one embodiment of a system for sharing signals from a portable media player in accordance with the present invention. As shown in FIG. 2 the system includes two ear buds 30, which are connected to electrical cables 32 and 34. The two cables 32 and 34 are connected together to form a single cable 36 and the cable 36 is connected to a breakaway connector 40. The breakaway connector is connected to a media player connector 42 by a cable 44, and the media player connector 42 can be plugged into a conventional media player, not shown.

With reference now to FIGS. 3-6, the breakaway connector 40 is shown engaged with a second headset connector 46 which provides electrical connection to a second headset. The second headset and the cables which form part of the system for sharing signals from a portable media player are not shown in FIG. 3. The second headset connector 46 is conventional and includes an insulated grip 50 and a plug 48 which includes three electrical contact sections 52, 54 and 56. The electrical contact sections 52 and 54 are separated by insulator 60, and electrical contact sections 54 and 56 are separated by insulator 62.

The breakaway connector 40 includes a jack 70 which is partly encased in a housing 72. The housing 72 includes a first cable coupling 74 to connect the housing 72 to first cable 36, which in turn is connected to ear buds 30, and the housing 72 further includes a second cable coupling 76 to connect the housing 72 to second cable 44 which in turn is connected to media player connector 42. Between the coupling 74 and coupling 76 the housing 72 includes a port 73 to partly surround the jack 70. It should be understood that the housing 72 provides electrical connection between the jack 70, the ear buds 30 and the media player connector 42, although those electrical connections are not illustrated.

Figure 8:
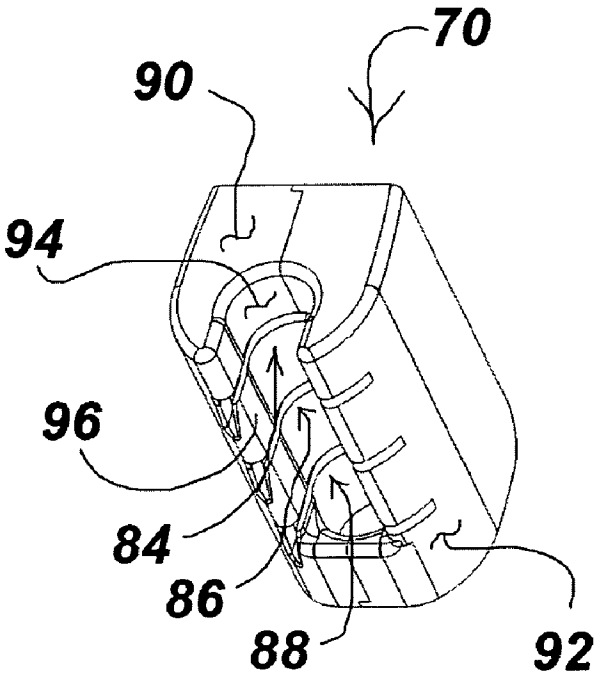
FIG. 8 is an isometric view of the components of FIG. 8 assembled together.
Figure 7:
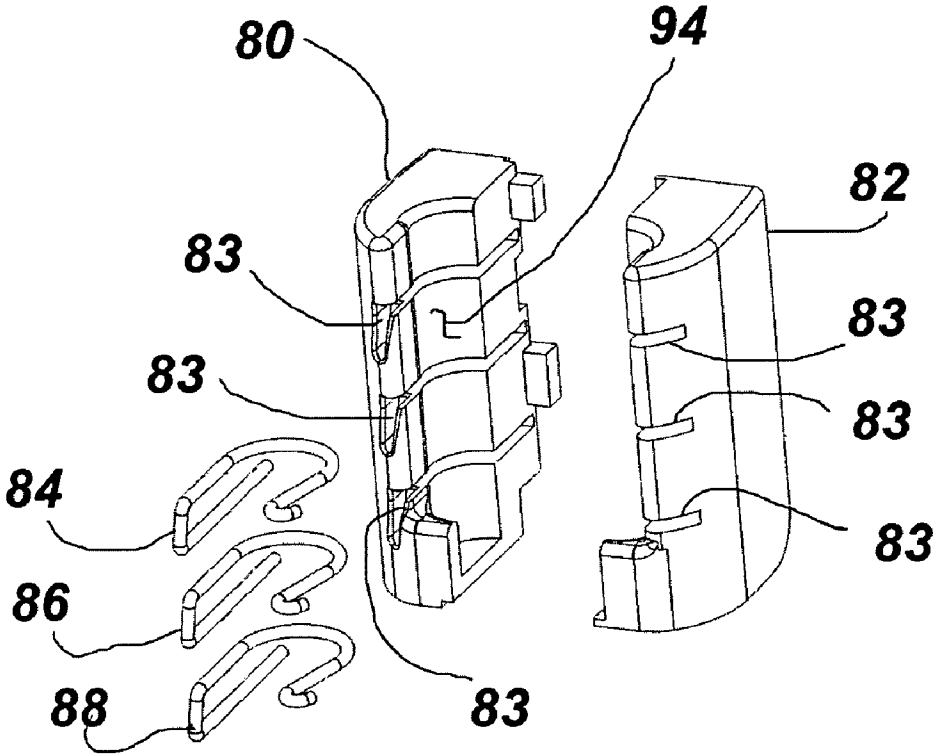
FIG. 7 is an exploded view of components of the breakaway connector of the present embodiment.
Figure 9:
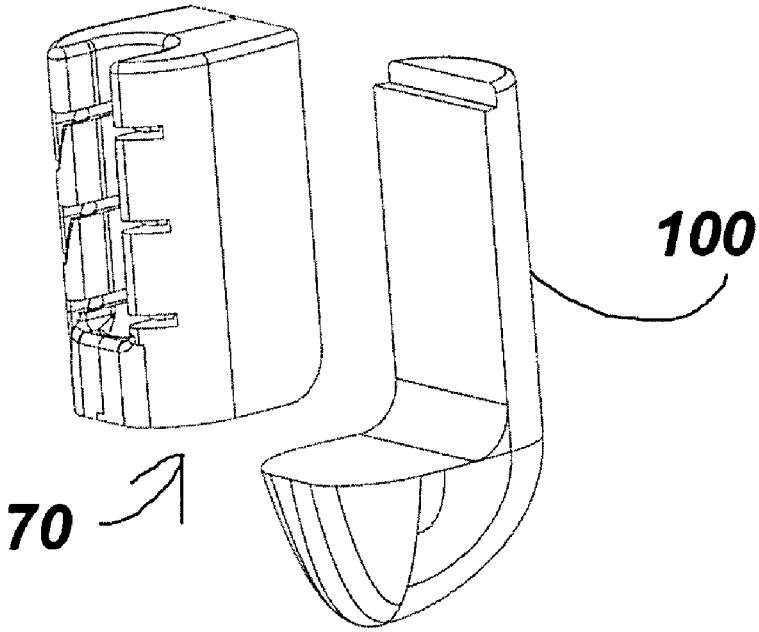
FIG. 9 is an isometric and partially exploded view of components of the breakaway connector.
Figure 10:
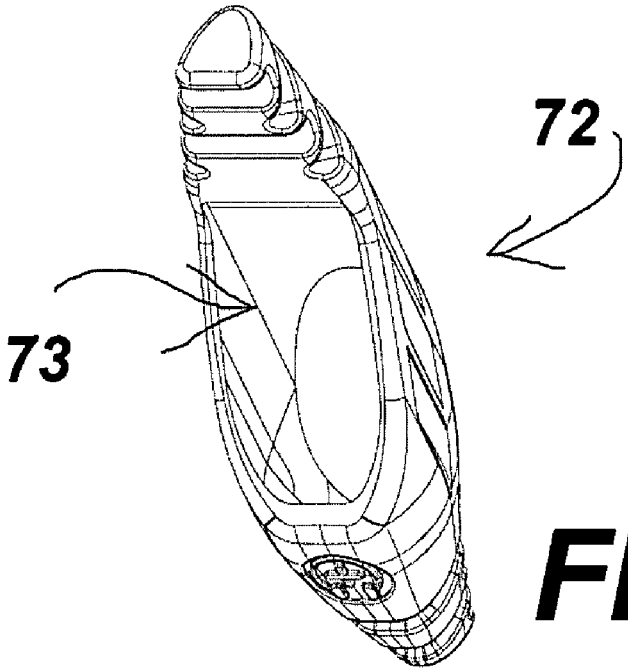
FIG. 10 is an isometric view of another component of the breakaway connector.

Turing now to FIGS. 7-10, details of the jack 70 and housing 72 are shown. As best shown in FIG. 7 the jack 70 includes a left section 80, a right section 82, and three resilient electrical contacts 84, 86 and 88. The left section 80 and right section 82 include slots 83 to accept the contacts 84, 86 and 88. When assembled, these components are as shown in FIG. 8. The jack 70 has a top face 90 and a front face 92 which are orthogonal to each other, and hole through the first face forms a port 94 in the jack 70 which is sized and shaped to accommodate plug 48. The port 94 is connected to the upper part of the front face 92 by slot 96. The jack 70 is mounted on a base 100, and the jack 70 and base 100 are mounted in the port 73 of housing 72. It should be understood that wiring is located in the housing 72 and the base 100 to carry electrical signals to the contacts 84, 86 and 88. However, for clarity the wiring is not shown.

Turning now to FIGS. 11-13, the operation of the device is shown. For the purpose of this description it can be understood that the plug 48 has an axis 102 and the port 94 has an axis 104. When the axis 102 and axis 104 are in the same plane, the plane formed by the axis 102 and axis 104 is the X-Y plane, while the direction orthogonal to the X-Y plane is the Z direction. To install the second headset connector 46 in the breakaway connector 40 the user orients the plug 48 so that the axis 102 and axis 104 are in the same plane (i.e. the X-Y plane) and the X-Y plane is aligned with the slot 96. Then the user moves the second headset connector 40 toward the breakaway connector 40 while keeping the plug 48 substantially in the same plane. Then the user rotates the plug 48 about the Z axis and pushes the plug slightly downwardly, as illustrated in FIG. 12. At this time the lower part of the plug begins to enter slot 96, and the plug engages the resilient contact 88 thereby causing the front portion to expand. As the user keeps pushing the plug in the same direction the plug 48 causes the front portions of contact 86 and then contact 84 to expand. As the plug 48 seats in the port 94 the contacts 84, 86 and 88 return to their normal configuration thereby capturing the plug 48 and holding it in position, as illustrated in FIG. 13. It should be understood that the user snaps the plug 48 into place in the port 94 by applying force to overcome the slight forces of the resilient contacts 84, 86 and 88. It should also be understood that when the plug 48 is seated, the contacts 84, 86 and 88 provide electrical contact with sections 52, 54 and 56 of the plug 48, respectively.

The depth of the slot is about the same as the diameter of the connector. We have found that this configuration significantly reduces the likelihood that a user can inadvertently touch the plug 48. The depth of the slot could be increased to further reduce this likelihood. Flexible flanges could be added to partially or completely enclose the connector.

The process for disengaging the plug 48 from the breakaway connector can be substantially the reverse of the installation process described above. That is, the step illustrated in FIG. 13 is the initial condition, followed by the step illustrated by FIG. 12 and then by the step illustrated by FIG. 11.

Figure 14:
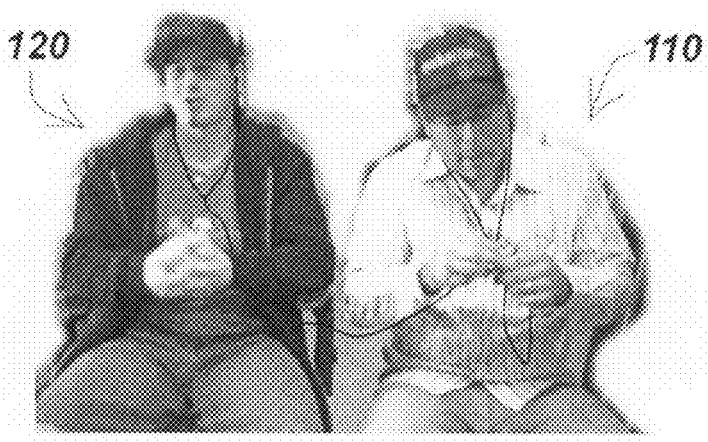
FIG. 14 further illustrates operation of the present embodiment.
Figure 15:
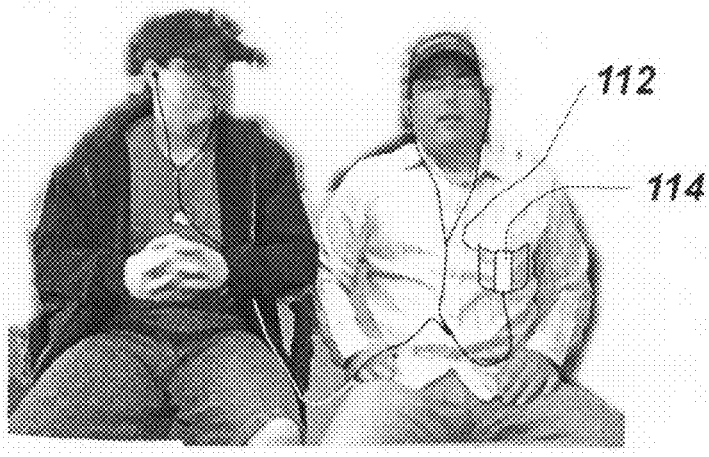
FIG. 15 further illustrates operation of the present embodiment.
Figure 16:
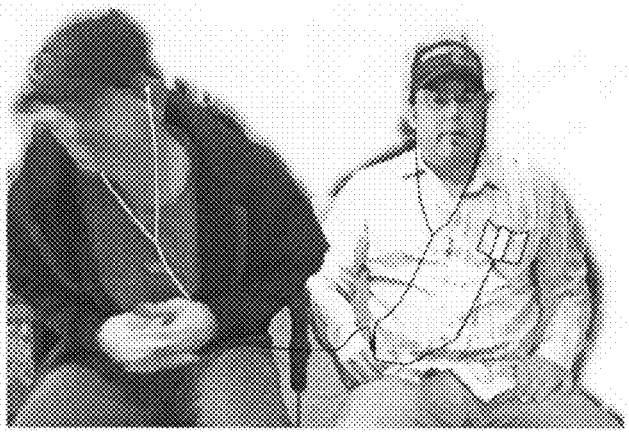
FIG. 16 further illustrates operation of the present embodiment.

FIGS. 14-16 further illustrate the operation of the system. In the figures a primary user 110 has a media player in his pocket 112 and media player is engaged to the pocket by a clip 114. In FIG. 14 the user is shown connecting the breakaway connector 40 to the second headset connector 46 which is being used by the secondary user 120. This corresponds to the steps described above in connection with FIGS. 11-12. In FIG. 15 the two users are listening to music and the breakaway connector 40 and the second headset connector 46 are engaged as shown in FIG. 13. Then, in FIG. 16 the secondary user 120 moves away from the primary user although neither user has carefully disengaged the breakaway connector 40 from the second headset connector 46. Accordingly, the breakaway connector 40 and the second headset connector 46 are pulled apart as shown in FIG. 12.

Figure 17:
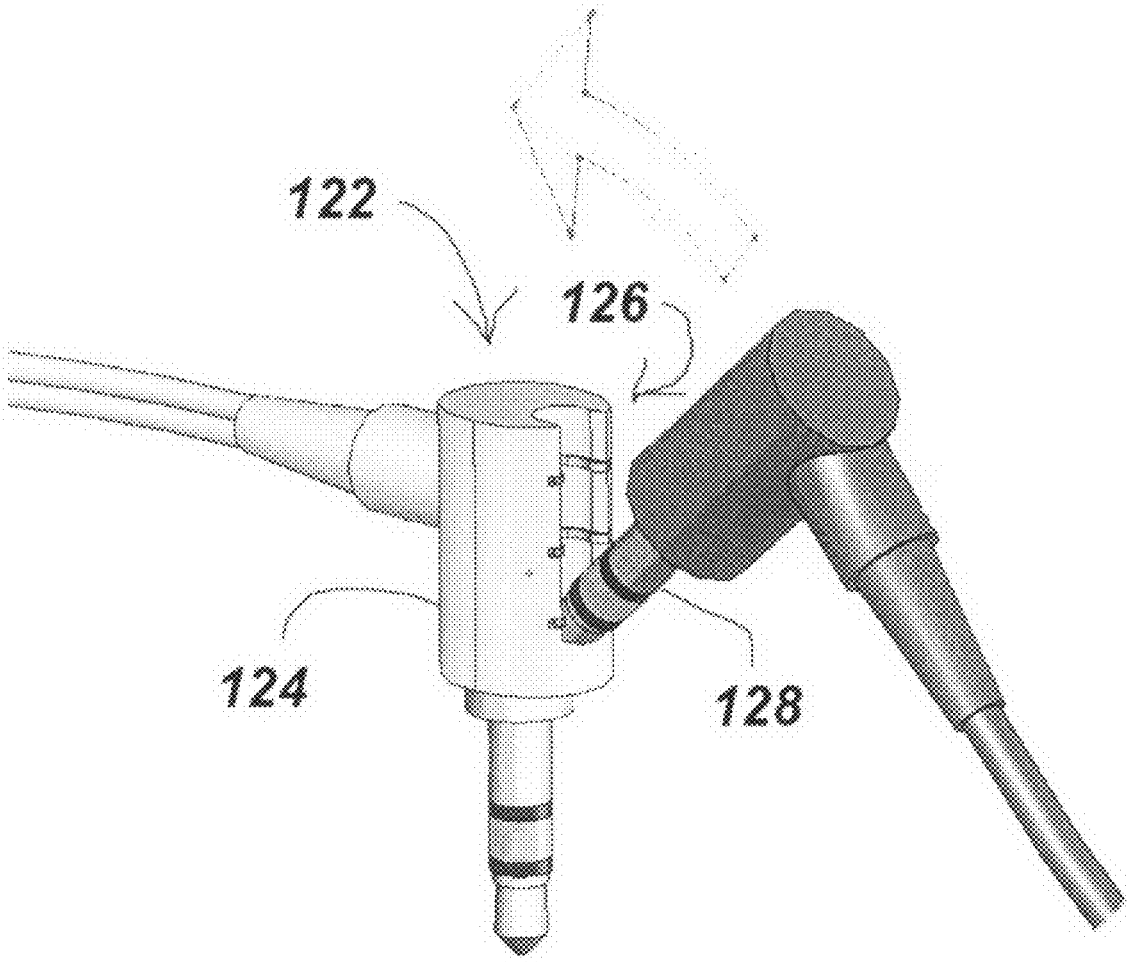
FIG. 17 illustrates an alternative embodiment of the present invention.

Turning now to FIG. 17, an alternative embodiment is shown. In this embodiment the breakaway feature is embodied in a breakaway media player connector 122. The breakaway media player connector 122 provides electrical connection between a media player and a primary headset, not shown. The breakaway media player connector 122 includes a cylindrical body 124 which comprises a breakaway connector. The breakaway media player connector 122 also includes media player connector jack 126 which is substantially the same in construction and operation as the jack 70 described above. It should be noted that in this figure an alternative type of second headset connector 126 is shown wherein the cable meets the plug 128 at a right angle. It should be appreciated that this type of headset connector 126 and the headset connector 46 can each be used with either of the breakaway connectors disclosed herein.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A device for sharing signals from a portable media player, the device comprising:

a) a headset;

b) a media player connector;

c) an electrical breakaway connector for sharing signals with another headset; and d) a cable electrically connected to said headset, said media player connector and said breakaway connector.

2. A device according to claim 1 wherein said breakaway connector comprises a jack having at least a first face and a second face; and, a first opening is formed in said first face and a second opening is formed in said second face so that a plug can be inserted through said first opening and said second opening.

3. A device according to claim 2 wherein said first face is substantially perpendicular to said second face.

4. A device according to claim 2 further comprising a resilient member coupled to said jack to engage the plug when the plug is located in said jack.

5. A device according to claim 4 wherein:

a) said jack comprises a port to accommodate a plug;

b) said first opening is formed in communication with said port;

c) said second opening is formed in communication with said port; and, d) said resilient member is located in said port.

6. A device according to claim 1 wherein said breakaway connector comprises a jack which is constructed to engage a plug, and the jack has a first port in a first face and a second port in a second face to accept the plug.

7. A device according to claim 6 wherein said first face is substantially orthogonal to said second face.

8. A device according to claim 6 wherein said first port is connected to said second port.

9. A device according to claim 1 wherein said breakaway connector comprises a jack having a port to engage a plug;

the plug has an axis and the jack has an axis, so that when installed the axis of said plug is coincident with the axis of said jack; and, said jack is constructed and arranged so that said plug can be removed from the jack by rotating said plug about a line which is perpendicular to the axis of the plug.

10. A device according to claim 1 wherein said breakaway connector comprises a port which is substantially U-shaped in cross section.

11. A device according to claim 1 wherein said breakaway connector is coupled to said cable.

12. A device according to claim 1 wherein said breakaway connector is coupled to said media player connector.

13. A device according to claim 1 further comprising electrical contacts formed in said breakaway connector.

14. A device according to claim 13 wherein said electrical contacts are constructed to resiliently engage a plug.

15. A system for sharing signals from a portable media player, the system comprising:

a) a first headset including a first earphone set, an electrical breakaway connector for sharing signals with another headset, the electrical breakaway connector comprising a jack having at least a first face and a second face, wherein a first opening is formed in said first face and a second opening is formed in said second face so that a plug can be inserted through said first opening and said second opening, a media player connector, and a first cable connected between said first earphone set, said breakaway connector and said media player connector;

b) a second headset including a second earphone set, a plug to releasably engage said breakaway connector, and a cable connected between said second earphone set and said plug.

16. A system according to claim 15 wherein said breakaway connector is coupled to said first cable.

17. A system according to claim 15 wherein said breakaway connector is coupled to said media player connector.

18. A method for using two headset systems with the same portable media player the headset systems include a first headset system having a plug and an electrical breakaway connector for sharing signals with another headset, the electrical breakaway connector comprising a jack having at least a first face and a second face, wherein a first opening is formed in said first face and a second opening is formed in said second face so that a plug can be inserted through said first opening and said second opening, and a second headset system having a plug, the method comprising:

a) engaging the plug of the second headset system in the breakaway connector; and thereafter, b) disengaging the plug of the second headset system from the breakaway connector by moving the plug away from the breakaway connector while rotating the plug about an axis perpendicular to the axis of the plug.

19. A method according to claim 18 wherein the step of engaging the plug comprises applying force greater than a first predetermined force to snap the plug into place.

20. A method according to claim 19 wherein disengaging the plug comprises applying force to the plug greater than a second predetermined force to unsnap the plug.

21. A method according to claim 18 wherein said second headset system includes earphones which are connected to the plug by a cable, the method further comprising disengaging the plug of the second headset system from the breakaway connector by applying tension to the cable.

22. A method according to claim 21 wherein tension is applied to the cable in a direction which includes a substantial component which is orthogonal to the axis of the plug.

23. A method for using a first headset system having a plug and an electrical breakaway connector for sharing signals with another headset the electrical breakaway connector comprising a jack having at least a first face and a second face, wherein a first opening is formed in said first face and a second opening is formed in said second face so a plug can be inserted through said first opening and said second opening and a second headset system having a plug, the method comprising:

engaging the plug of the second headset system with the breakaway connector by moving the plug toward the breakaway connector while rotating the plug about an axis perpendicular to the axis of the plug.

* * * * *